US005505025A

United States Patent [19]

Fleishman

[11] Patent Number: 5,505,025

[45] Date of Patent: Apr. 9, 1996

[54] STRESSED PANEL STRUCTURE

[76] Inventor: Gregg R. Fleishman, 2732 S. La Cienega, Los Angeles, Calif. 90034

[21] Appl. No.: 349,926

[22] Filed: Dec. 6, 1994

Related U.S. Application Data

[62] Division of Ser. No. 184,241, Jan. 19, 1994, Pat. No. 5,406,757, which is a division of Ser. No. 793,101, Nov. 15, 1991, abandoned.

[51] Int. Cl.[6] ..... E04B 7/08

[52] U.S. Cl. ..... 52/81.1; 52/648.1; 52/DIG. 10

[58] Field of Search ..... 52/81.1, 81.4, 52/80.1, 80.2, DIG. 10, 648.1, 649.4, 655.2

[56] References Cited

U.S. PATENT DOCUMENTS 5,448,868 9/1995 Laluani ..... 52/81.1 X

*Primary Examiner*—Creighton Smith

*Attorney, Agent, or Firm*—Lyon & Lyon

[57] ABSTRACT

A Stressed Panel Structure forming checkerboard spheroids and non-checkerboarded conical sections are formed using semi-rigid panels of wood or other materials with generally elongated slots or holes in their corners. Panels are placed corner to corner and a pin or rod is inserted therebetween, becoming stressed when panels are positioned at proper dihedral angles along their axis of intersection. Stressing results generally in bending or other distress of the panel or pin or both.

2 Claims, 5 Drawing Sheets

Fig. 1.
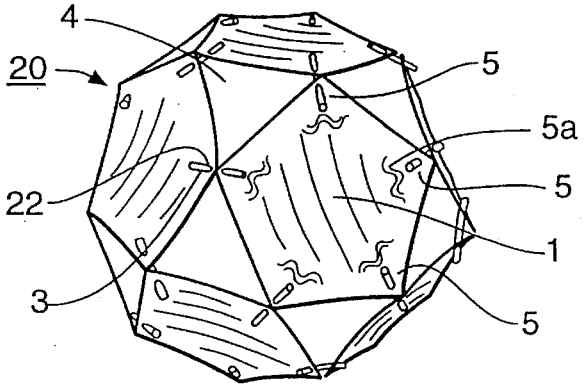
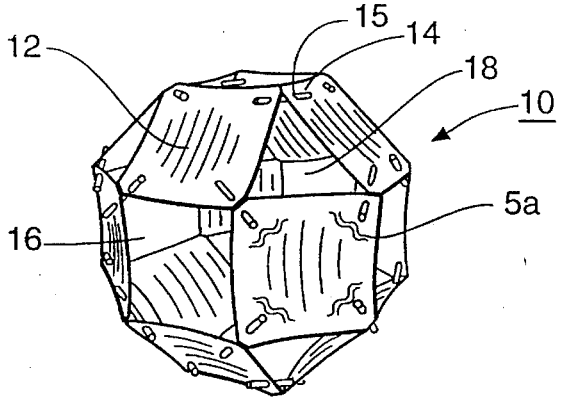
Fig. 2.
Fig. 3.
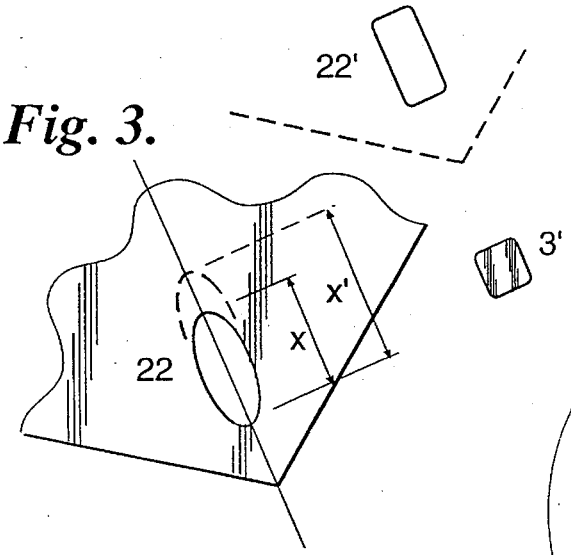
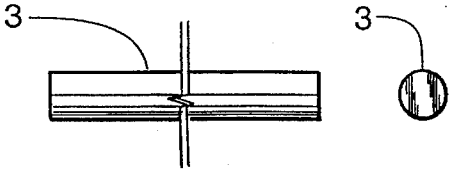
Fig. 4.
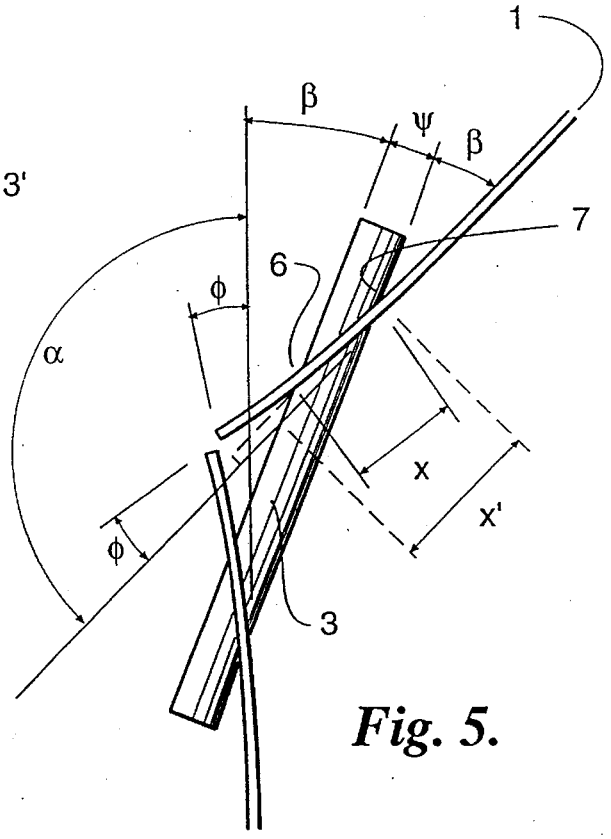
Fig. 5.

STRESSED PANEL STRUCTURE

This application is a divisional of Ser. No. 08/184,241, filed Jan. 19, 1994, which is now U.S. Pat. No. 5,406,757, which is a division of Ser. No. 793,101 filed Nov. 15, 1991, now abandoned.

BACKGROUND OF THE INVENTION

Panel structures that are known in the art have used bendable panels and panels with a combination of connecting devices and frames to create structures.

Generally, panel structures used for shelter or habitation have evolved into spherical forms when they have entirely been constructed of panels. This form results because of its structural and geometric efficiency. Generally aligned in some manner related to geodesics, which reduce the numbers of different types of component parts, experimental thin panel structures have been constructed to 40' diameter using bent ¼" plywood sheets bolted together face to face on overlapping portions of the panels. These structures have relied on bending to achieve the spherical curvature and therefore generally have been constructed of thin panels without adequate strength to support surface loading and have had long portions of their edges or surfaces in contact.

The basic frame geodesic structure, as is known in the art, has a basic frame structure normally covered with an appropriate skin or array of surface panels to provide a weather-tight enclosure. Surface panels generally can be thick enough to support surface loading as they do not bend, but rather, meet angularly along the lines of the geodesic frame structure to which they are attached for support. In some cases, where the frame elements are pre-attached to the surface panels, the structures could be called panel structures although the load bearing parts of the structure are comprised of the frame. However, no significant bending forces or axial loads are imposed on the panels, with the exception of their own weight and applied surface loading as described above.

Additionally, some kind of attachment device is required at the intersections of the structural panels or frames. Bolts, nuts, straps, clamps, and similar securing devices have been used in the past. Normally, such fasteners are made of metal and require special tools for securing the same. Further, where bolt holes and the like are provided, fairly close tolerances and angular preciseness must be maintained in the dimensioning of all of the component parts in order that proper registration will occur to enable proper fastening of the various panels to the frame. U.S. Pat. No. 4,308,698, issued to this inventor on Jan. 5, 1982, and incorporated herein by reference, discloses bendable panels that are also used to simplify the methods of connection. However, the preferred embodiment provides a frame structure where only the connecting device is the bendable portion of reference. Although another embodiment having a bendable structure is disclosed, it utilizes continuous edges for connection, and the flexibility required necessitates thin panels unable to support surface loading. Additionally, in its spherical form, all of the panels are triangular.

All of the foregoing characteristics of prior art structures make the assembly and disassembly of such structures a time-consuming operation. Moreover, because of the various different types of fastening means employed, not only are special tools required, but the overall expense of manufacture and of the materials employed is greater. Using fewer different types of component parts and a wider selection of materials would reduce the overall cost.

SUMMARY OF THE INVENTION

With the foregoing considerations in mind, the present invention contemplates panel structures or portions thereof, consisting primarily of panels of similar shapes and sizes as the dominant structural elements. No additional skeletal framework of linear strut members is required, except where strut-like members form the connections between panels.

These panels generally meet angularly and have sufficient strength to support surface loading. Although connections can be conventional, a key feature of the invention is how the panels are utilized so as to simplify and minimize the number of interconnecting devices.

Briefly, in this new invention, individual panels are formed of semi-rigid material and are dimensionally shaped so that only the corners can flex upon installation, thus creating bending forces. These bending forces are not utilized to achieve the spherical curvature but are utilized in the method of attachment. This attachment can be accomplished using simple pins, which can be constructed from a variety of materials, and can be either rigid or flexible, depending upon the specific application and the comparable stiffness of the panels. The pins are held in place due to friction provided by the stress which results in the panels when connecting the vertices. Friction created by bending forces negates the need for other attachment devices or bonding materials such as glue.

The panels can be constructed in a variety of shapes. Common shapes used for a preferred embodiment include panels that are substantially triangular, square and polygonal (e.g., pentagonal, hexagonal). Each panel has a series of slots or holes (these terms are used interchangeably hereinafter), with a single slot generally located near each outward vertex of each panel. The panels are interconnected using pins that are inserted into the slots of corresponding panels. Generally, a triangular panel is used for cone shapes and will have two holes for interconnection at the structure's edges and another type of connector at the third (center) vertex. A square panel is used for spherical forms and will have four holes; a pentagonal panel will also be used for spheres and have 5 holes, and so forth.

The disclosed stressed panel structure can be utilized in a number of different configurations and applications. For example, full spheroidal forms may consist of twelve square or pentagonal panels, or of a forty-two panel form comprising twelve pentagons and thirty hexagons. In addition, lesser numbers of panels similarly aligned form various portions of a spheroid. It is contemplated that other combinations are possible using similar structures. The characteristic checkerboard appearance of the spheroids results from the panel placement. The panels are placed and interconnected vertex to vertex such that open spaces result on either side of each connection. In most embodiments, these open spaces are generally triangular.

In the conically formed structures, the panels are generally triangular, some tending toward being pie shaped. These structures can each be formed from combinations of like panels, such combinations consisting of at least three panels, with a possibility of eight or more. The pin members are generally arranged in a circular array and connect the outward corners of the panels. The panels are placed with their sides adjacent and the resultant structure does not exhibit the checkerboard effect of the spheroidal structures. They do occasionally result in a generally circular opening at the center portion or top which can be connected by attachment means to an ancillary support structure such as a pole.

In the spheroidal forms, the bending forces applied to the panel by the interconnecting pins generally result in concave panel deformations relative to the curvature of the structure when the pin members are straight. When the pin members are not straight but are bent or formed in other ways, stresses can produce a resultant structure where the panels are convexly bent. In the conical structures, the panels, after being interconnected, can be either of concave or convex form.

BRIEF DESCRIPTION OF THE DRAWINGS

A more thorough disclosure of the features of the present invention is set out in the brief descriptions of the drawings which are described below:

FIG. 1 is a perspective view of one of the preferred embodiments using the stressed panel structures. This embodiment contains panels that are shaped substantially pentagonal. The gaps between the panels in this embodiment are shaped substantially triangular.

FIG. 2 is a perspective view of one of the preferred embodiments using panels that are shaped substantially square.

FIG. 3 is a top view of the vertex of a panel, illustrating the location of the slot or hole near the corner of the panel. In this embodiment, the hole is shaped substantially elliptical. A substantially rectangular hole and a substantially square pin are also illustrated.

FIG. 4 illustrates a side view and an end view of a cylindrical pin that could be utilized in combination with the embodiment illustrated in FIG. 3.

FIG. 5 is a side view of the interconnection of two corresponding panels, showing the geometry of the pin inserted through the two slots in the vertices of the panels.

DETAILED DESCRIPTION OF DRAWINGS

Figure 6:
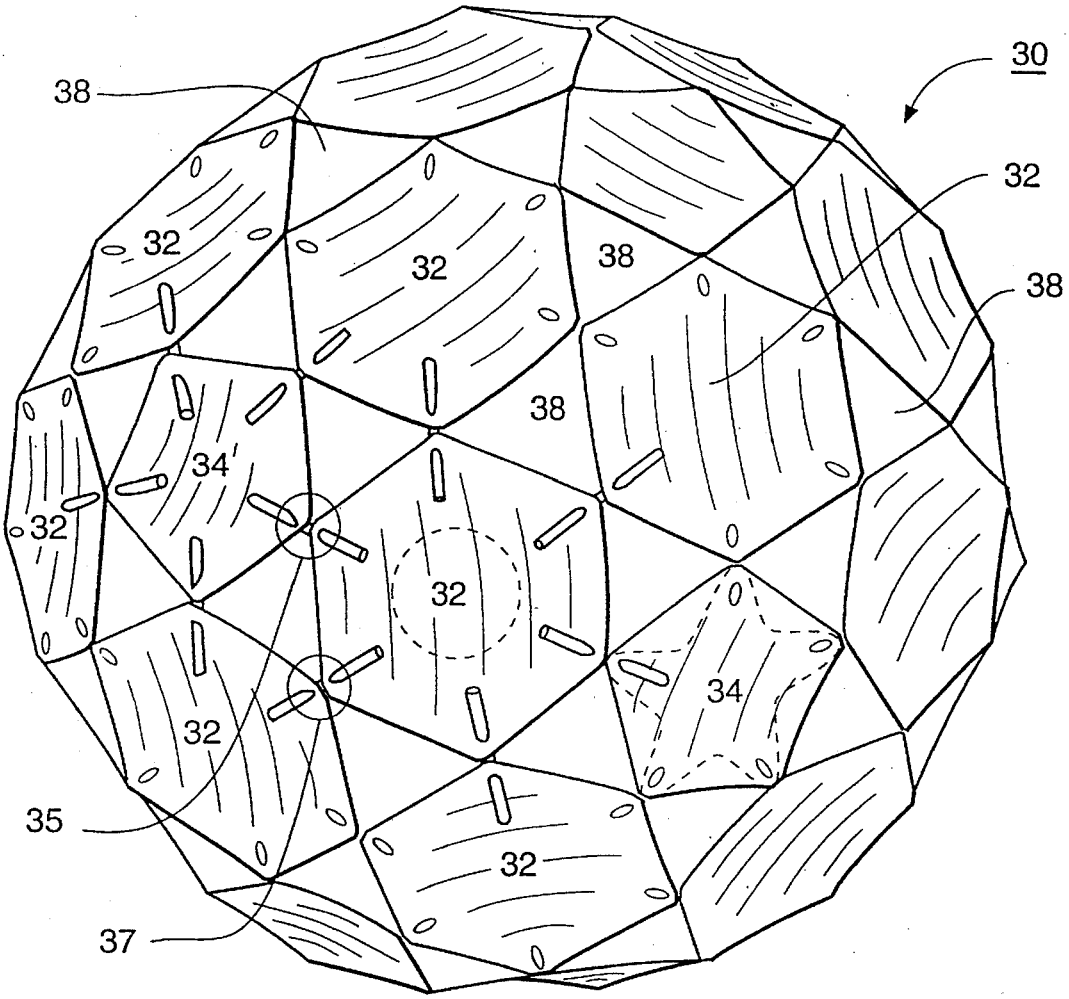
FIG. 6 is a perspective view of a spheroid constructed using substantially pentagonal panels and substantially hexagonal panels.

The present invention relates to a stressed panel structure that has, inter alia, a series of stressed panels that are interconnected to each other with a series of slots and pins.

Turning now to a detailed description of the preferred embodiments, illustrated in FIGS. 1 through 7. Individual panels are used in such a way as to create a stressed panel structure. FIG. 1 illustrates one configuration of a checkerboard spheroid 20, utilizing pentagonally shaped panels (1). In this configuration, identical panels 1 are used for the entire structure. Each outward vertex 5 of each panel is connected to an outward vertex of a corresponding panel, to create a structure. Each of the panels has a slot 22 formed near the outer portion of each vertex. These slots can be of different shapes, depending upon the shape of the connecting pin 3. FIG. 3 illustrates an oval slot 22 designed to function with a cylindrical pin 3 as shown in FIG. 4. FIG. 3 also illustrates a rectangular slot 22', designed to function with a square pin 3'.

The panels 1 are manufactured individually and are generally planar prior to integration into the structure. The structure is assembled by inserting the pins into the slots and then flexing the panels, resulting in bending stresses exerted primarily near the outward vertices 5 of the panels 1 where the slots 22 and the pins 3 are situated. The center of the panel is substantially unstressed with the areas of maximum stress shown generally by wavy lines *5a* indicating their general concentration and location. FIG. 5 shows the geometric arrangement of the panels and pins. The panels create twisting forces that are exerted perpendicular to the axis of the pin. The effect is that the pin will be held in place by the resulting force and friction. The tensioned panels are constrained from further movement due to the relative rigidity of the tensioned pins.

The length of the hole or the slot varies with the amount of bending of the panels. FIGS. 3 and 4 show the length of the slot required in the bent configuration (X), versus that which would be required if the panels were straight (X'). As the length of the hole gets shorter, the angle of deflection (Ø) gets larger. The angle of deflection is the angle between the panel at rest and the deflected panel. This results in a larger twisting force exerted in the pin at points 6 and 7 in FIG. 5. This twisting force acts to hold the pins and panels together. As long as X is significantly less than X', adequate bending forces will be applied. The pin angle ($\beta$) and the dihedral angle ($\alpha$) are inherent and fixed by the shape of the structure. The panels are held in place by bending forces and do not need to be precision fit.

An entire structure can be constructed using various panel and pin combinations. FIG. 1 shows such a structure using pentagonal panels. In FIG. 1, substantially pentagonal panels 1 are attached by means of holes 22 and pins 3 located at the vertices of the pentagons. The pentagonal panels 1 create adjacent triangular openings 4. This method of construction can also be used to create hemispherical or other sections which are portions of a sphere.

FIG. 2 shows a structure 10 using square panels. FIG. 2 shows a structure comprised of substantially square panels 12 connected to other square panels at their vertices by pin 14 and hole 15 assemblies of the same nature as those shown in FIG. 1. By virtue of the vertex to vertex alignment openings 16 which are square and openings 18 which are triangular are formed in a checkerboard pattern comprising the structure.

Figure 7:
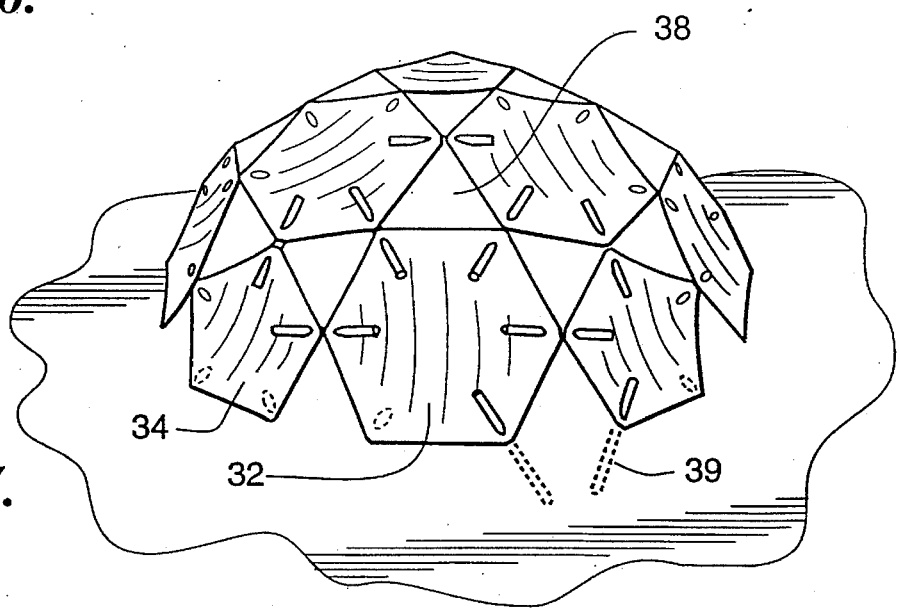
FIG. 7 is a perspective view of the top half of the structure showing in FIG. 6, illustrating its use as a dome.

Different shaped panels could be used in the same structure. For example, FIG. 6 and 7 illustrate an embodiment where pentagonal shaped panels are used with hexagonal panels. The structure 30 in FIG. 6, is constructed by joining 30 substantially hexagon shaped panels 32 to substantially pentagonal shaped panels 34 and other substantially hexagonal shaped panels. Pentagonal-hexagonal connections are generally shown at numeral 35 while hexagonal to hexagonal connections are generally shown at numeral 37. On opposite sides of each connection point 35 and 37 are triangular openings 38 of which eighty (80) are comprised within a full spheroid form. Pin and hole (or slot) assemblies as shown in FIGS. 1–9 are used to connect the panels. Conventional attachments such as bracket 58 and bolt 59 (FIG. 17) can also be used to form the connections between panels in these geodesic structures. Also, as with other figures the drawings are abbreviated and not necessarily to scale, and no pins and holes are shown in some panels. Portions of all of the disclosed structures can also be used. For example, FIG. 7 illustrates how such structures can be used for habitation, using a portion of the structure generally disclosed in FIG. 6. The open triangular spaces 38 can be used as windows when translucent members are inserted in the open spaces. Pins 39 are used as connecting members to the ground or to a conventional foundation or base (not shown).

Figure 8:
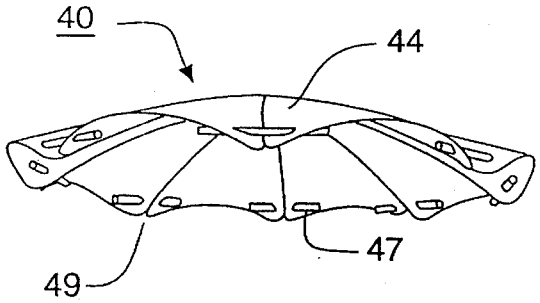
FIG. 8 is a side view of an embodiment using substantially triangular panels to form a conically shaped structure. The panels are flexed to form convex sections, when viewed from below.
Figure 9:
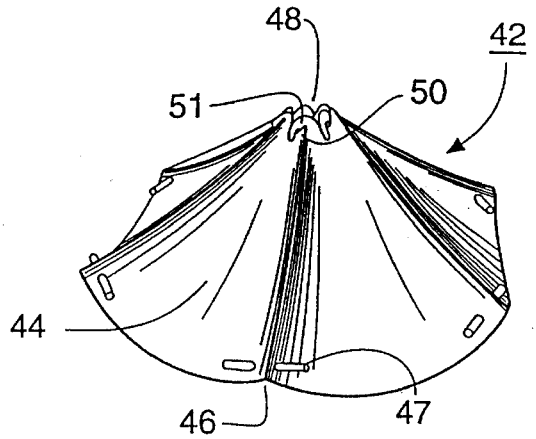
FIG. 9 is a top view of an embodiment using substantially triangular panels to form a conically shaped structure. The panels are flexed to form concave sections, when viewed from below.

FIGS. 8 through 12 depict variations of the use of the panel and pin combinations to construct conical structures. These may be used as, for example, umbrella or lamp structures. FIGS. 8 and 9 illustrate conically shaped structures 40 and 42 that are formed in the shape of an umbrella using panels 44 that are substantially triangular. Interconnections 46 and 49 at the outer edges of the panels are made using the same system described earlier, whereby the pins 47 are held in place by the forces exerted by tensioned panels 44.

FIG. 9 shows a variation of the interconnection means for one corner of the substantially triangular panels 44. The retention means 48 shown illustrate a tongue 49 and notch 50 configuration. This interconnection is shown to emphasize that the tensioned member interconnection can be used in conjunction with other conventional attachment means.

Figure 10:
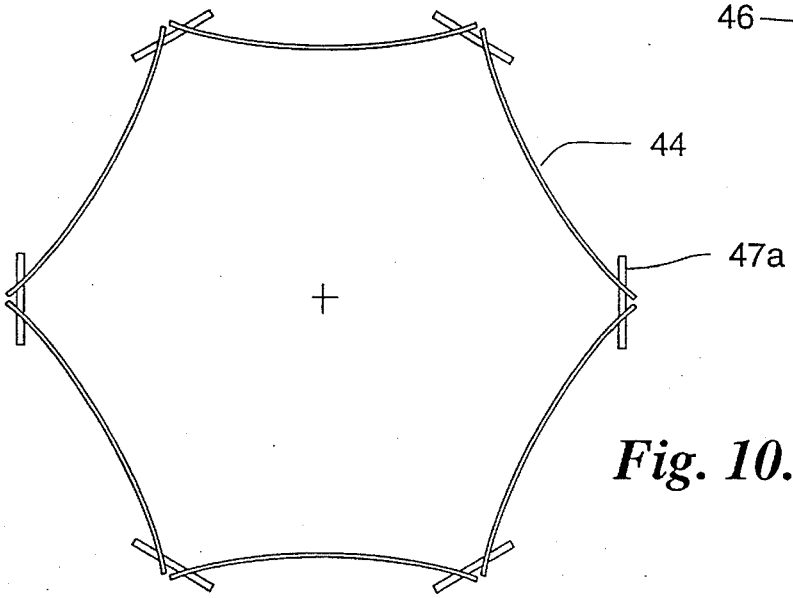
FIG. 10 is a horizontal, rotationally segmented section, illustrating the location of the pins and the bending of the panels of the conical object shown in FIG. 9.
Figure 11:
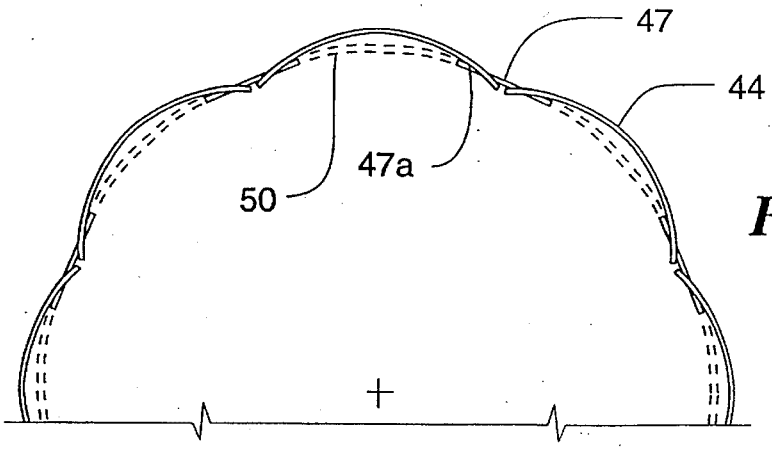
FIG. 11 illustrates the location of the pins and the bending of the panels of the conical object shown in FIG. 8. The dashed lines illustrate the continuous bar that can be used, as shown in FIG. 15.

FIGS. 8 through 11 also show that the panels can be flexed outward or inward from the center of a conical structure. For panels that are flexed inward (concave), as shown in FIGS. 9 and 10, the ends of the pins 47*a* protrude to the outside of the conical structure. For panels that are flexed outward (convex), as shown in FIGS. 8 and 11, the ends 47*a* of the pins protrude to the inside of the conical structure. Of course, the pin 47 could be continuous as indicated by the dotted lines 50. This is further indicated by pin 60 in FIG. 15.

Figure 12:
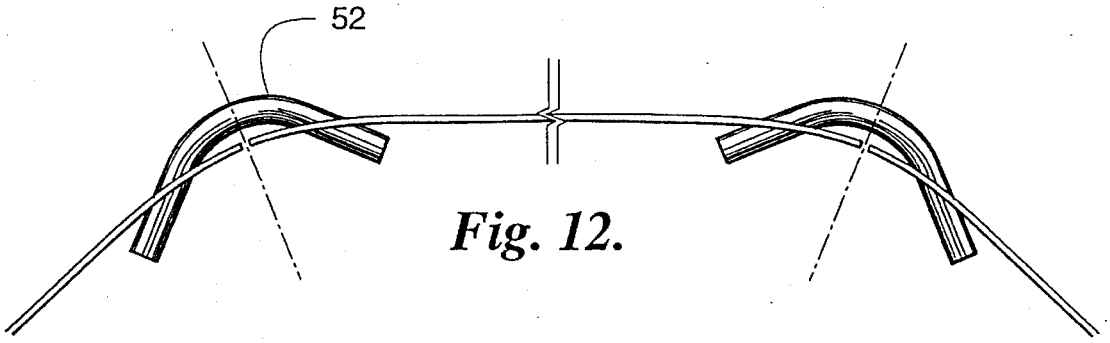
FIG. 12 illustrates a convex panel structure using bent pins.

FIG. 12 shows an alternate configuration for the pin and panel combination cut along Section AA in FIG. 6 where the pins are bent.

Figure 13:
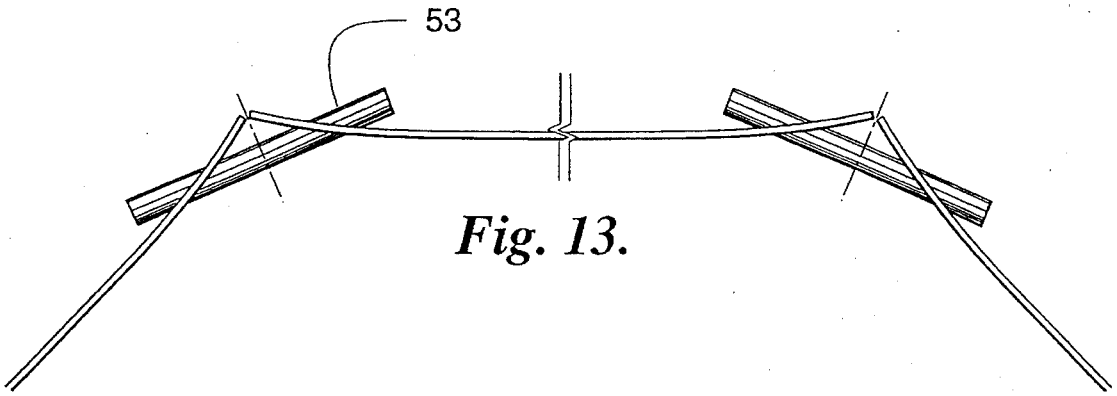
FIG. 13 illustrates a concave panel structure using straight pins.

FIG. 13 indicates the pin and panel combination cut along section AA in FIG. 6.

Integration of the panels and pins can be accomplished in two different ways. One method is to use bent pins 52 as shown in FIG. 12. Bent pins are particularly appropriate for structures using convex panels, where the pin angle Ø is small (pin angle Ø is illustrated in FIG. 5). Conversely, straight pins 53 can be used, as shown in FIG. 13.

Figure 14A:
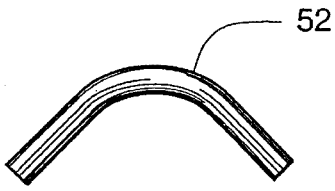
FIG. 14 illustrates possible embodiments for bent pins.
Figure 14B:
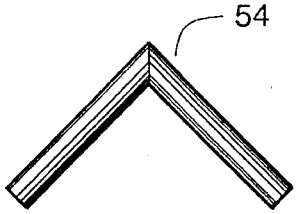
Figure 14C:
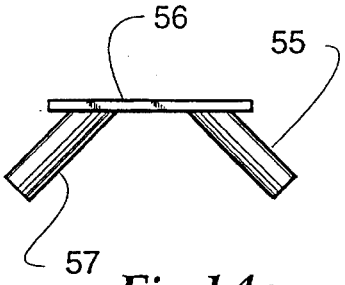
Figure 17:
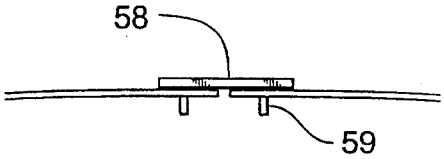
FIG. 17 illustrates conventional means for fastening panels to one another.

FIG. 14 illustrates various embodiments of bent pins. FIG. 14(*a*) illustrates the bent pin 52 of the same type showing FIG. 12. FIG. 14(*b*) illustrates an angle pin 54. FIG. 14(*c*) shows a pin formed by welding pin sections 57 to flat plate 56. Of course, straight pins 53 such as those set out in FIG. 13 can be used, while conventional means for attachment such as a member 58 and bolts or rivets 59 are shown in FIG. 17.

Figure 15:
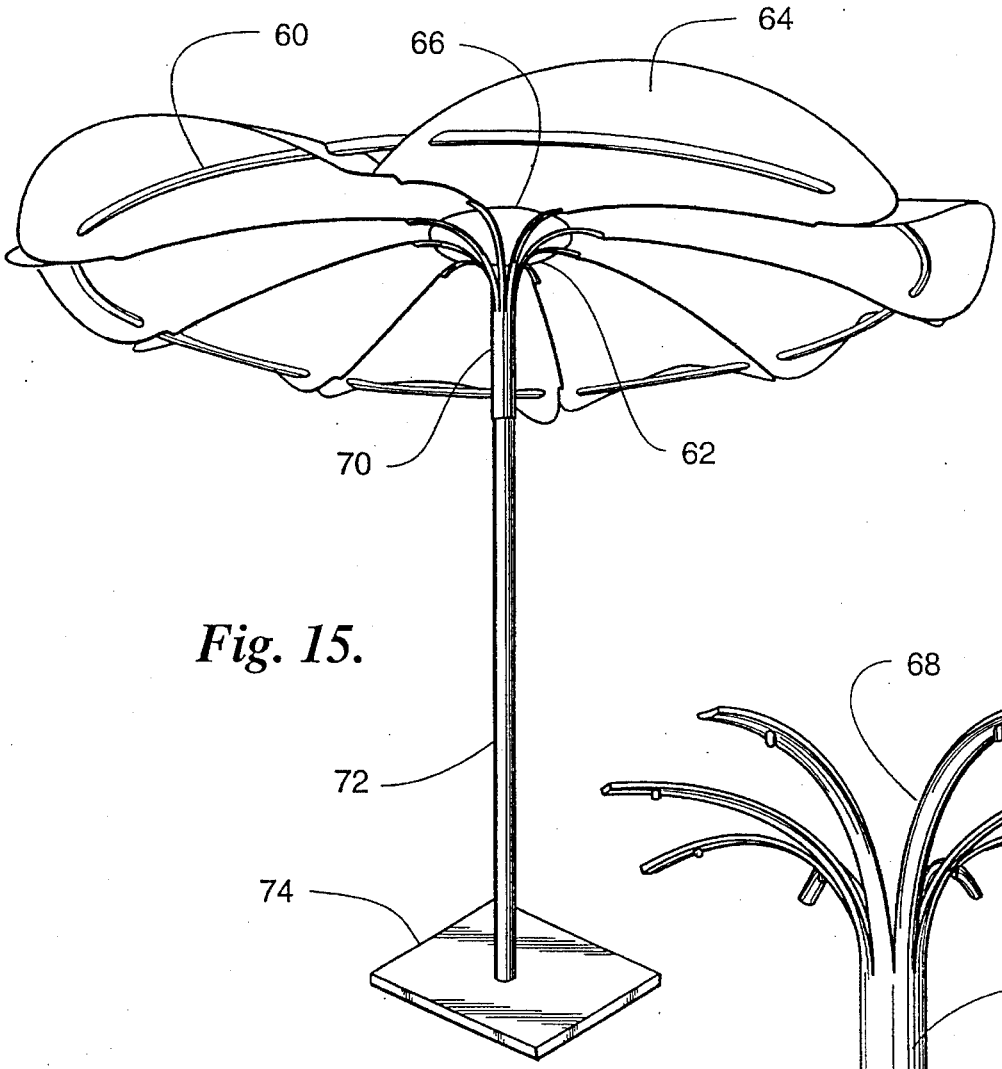
FIG. 15 shows an embodiment where substantially triangular panels form a substantially conical shape. In this embodiment, individual pins are replaced with a continuous bar that runs the entire circumference of the structure, and the individual panels are attached by conventional means to a center support that has a sectionally splayed tube.
Figure 16:
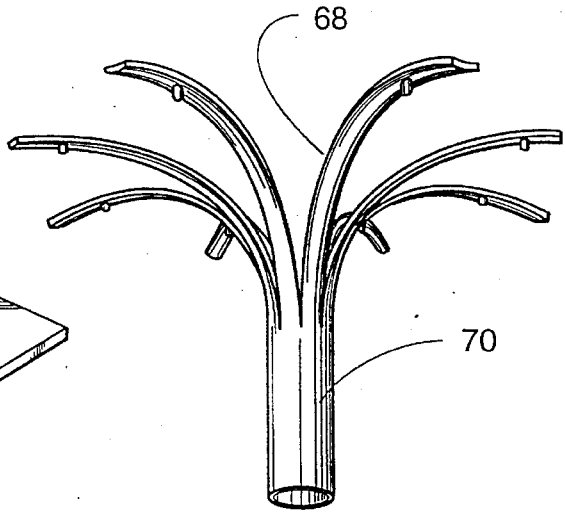
FIG. 16 is an enlarged view of the sectionally splayed tube shown in FIG. 15.

FIG. 15 shows another variation in configuring the panels. The primary difference with this conical structure (which can be used as a lamp or on a larger scale, as an umbrella), versus that shown in FIGS. 8 through 12, is that multiple, discrete pins have been replaced with a single, continuous "pin" 60, that spans the entire circumference of the structure. FIGS. 15 and 16 also illustrate a variation in the attachment 62 of the center vertex of each of the substantially triangular panels 64. The center vertices 66 of each panel are attached to the center support 70 using conventional means instead of tongue and notch assemblies such as those in FIG. 9. This embodiment illustrates the use of a tube or pole 72 sitting on base 74 fitted to center support 70 shaped as a sectionally splayed tube having fingers 68 attached integrally to provide the attachment means for the center support. See FIG. 16.

Thus, an improved structure is disclosed. While the embodiments and applications of this invention have been shown and described, it would be apparent to those skilled in the art that many more modifications are possible without departing from the inventive concepts herein. The invention therefore is not to be restricted except in the spirit of the appended claims.

I claim:

1. A spheroid comprised of:

(a) substantially pentagonal panel members;

(b) substantially hexagonal panel members;

(c) said panel members oriented vertex to vertex;

(d) resultant open spaces comprising triangles;

(e) said panel members connected by at least 120 interconnections.

2. The spheroid of claim 1 wherein said panel members are interconnected using slots or holes and pins;

(a) said pentagonal panel members having five holes or slots each;

(b) said hexagonal panel members having six holes or slots each;

(c) said pins of appropriate size and rigidity to withstand bending forces exerted by tensioned panel members;

(d) said panel members and said pins used in combination to create stressed panel structures.

* * * * *

UNITED STATES PATENT AND TRADEMARK OFFICE

CERTIFICATE OF CORRECTION

PATENT NO. : 5,505,025
DATED : April 9, 1996
INVENTOR(S) : Gregg R. Fleishman

It is certified that error appears in the above-indentified patent and that said Letters Patent is hereby corrected as shown below:

On the title page, item

[62] Please change "Jan. 19, 1994" to --Jan. 1, 1994--.

| | |
|---|---|
| Column 3, Line 17 | Please insert --twelve-- after "contains". |
| Column 3, Line 17 | Please delete the word "shaped". |
| Column 3, Line 19 | Please delete the word "shaped". |
| Column 3, Line 21 | Please insert --twelve-- after "using" |
| Column 3, Line 21 | Please delete the word "shaped". |
| Column 3, Line 26 | Please delete the word "shaped". |
| Column 3, Line 36 | Please insert --twelve-- after "using". |
| Column 3, Line 36 | Please insert --thirty-- after "and". |
| Column 4, Line 16 | Please insert --twelve-- after "utilizing". |
| Column 6, Line 41 | Please insert --twelve-- after "(a)". |
| Column 6, Line 42 | Please insert --thirty-- after "(b)". |
| Column 6, Line 45 | Please insert --eighty-- after "comprising". |

Signed and Sealed this

First Day of July, 1997

Bruce Lehman

*Attest:*

BRUCE LEHMAN

*Attesting Officer*

*Commissioner of Patents and Trademarks*